United States Patent [19]

Fries et al.

[11] Patent Number: 4,721,392

[45] Date of Patent: Jan. 26, 1988

[54] METHOD AND A DEVICE FOR INSTALLATION OF A MIXER

[75] Inventors: Hjalmar Fries, Spanga; Roland Narholm, Vaxholm; Bengt Thomaeus, Djursholm, all of Sweden

[73] Assignee: Flygt AB, Solna, Sweden

[21] Appl. No.: 847,809

[22] Filed: Apr. 3, 1986

[30] Foreign Application Priority Data

Apr. 4, 1985 [SE] Sweden ..... 8501700

[51] Int. Cl.[4] ..... B01F 7/06

[52] U.S. Cl. ..... 366/241; 366/282; 366/330

[58] Field of Search ..... 366/261, 279, 281, 282, 366/283, 284, 285, 286, 330, 331, 287, 251, 601, 241, 270, 280; 174/77 R

[56] References Cited

U.S. PATENT DOCUMENTS

| | | | |
|---|---|---|---|
| 859,943 | 7/1907 | Holden | 366/281 X |
| 1,830,533 | 11/1931 | Eby | 174/77 R X |
| 2,219,706 | 10/1940 | Jones | 366/251 |
| 2,574,958 | 11/1951 | Carr | 366/285 |
| 2,965,364 | 12/1960 | Parker et al. | 366/282 |
| 3,251,582 | 5/1966 | Murphy | 366/261 |
| 4,217,996 | 8/1980 | Good | 366/287 X |
| 4,464,259 | 8/1984 | Cramer et al. | 366/286 X |
| 4,511,257 | 4/1985 | Roberts | 366/286 X |
| 4,552,462 | 11/1985 | Schnell | 366/287 X |

FOREIGN PATENT DOCUMENTS

| | | | |
|---|---|---|---|
| 1201588 | 7/1960 | France | 366/282 |

*Primary Examiner*—Harvey C. Hornsby
*Assistant Examiner*—Scott J. Haugland
*Attorney, Agent, or Firm*—Menotti J. Lombardi

[57] ABSTRACT

A method and a device for installation of a mixer in a liquid tank is provided wherein the mixer is brought downwards into the tank along a guide which is pivotally attached in the upper part of the tank. During operation the reaction force from the impeller will cause the guide to pivot making the mixer take support against the tank wall.

4 Claims, 1 Drawing Figure

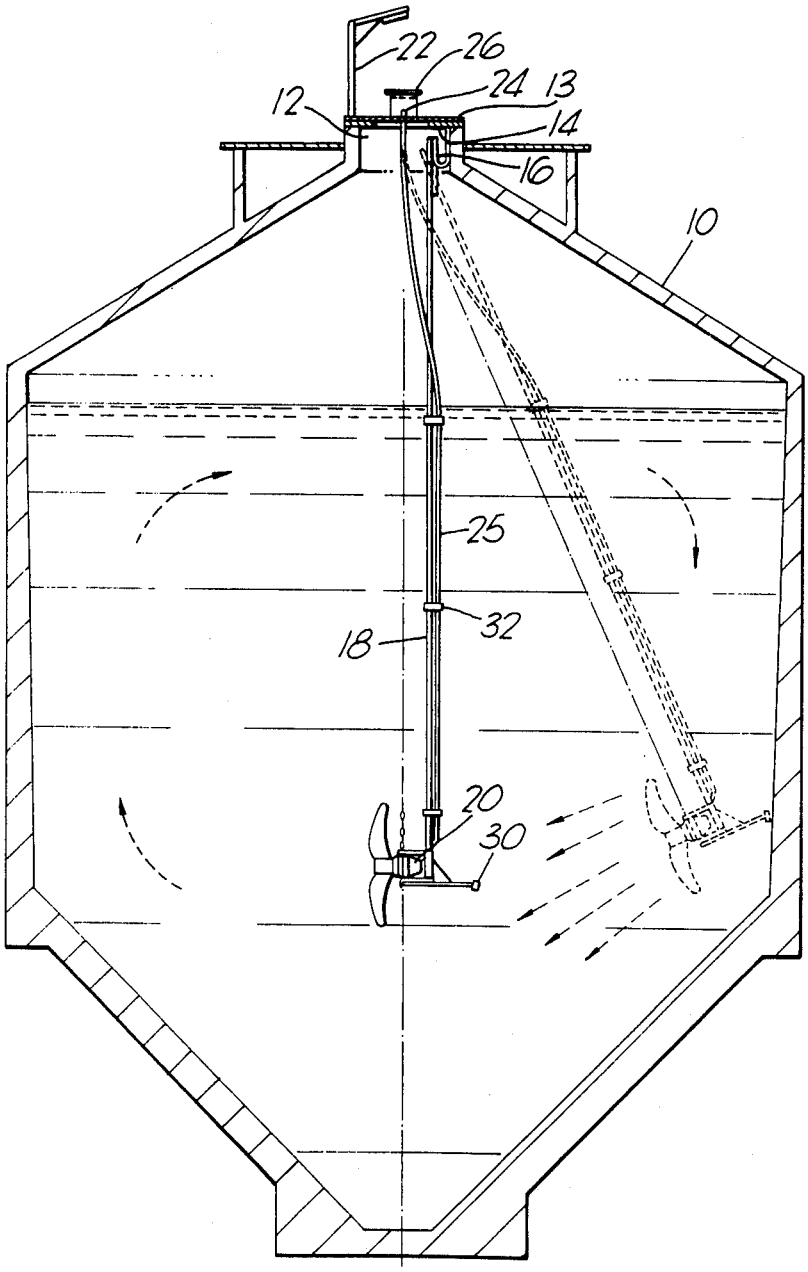
22
26
24
13
12
14
16
10
25
32
18
20
30

METHOD AND A DEVICE FOR INSTALLATION OF A MIXER

BACKGROUND OF THE INVENTION

The most common method of installing a submersible mixer is to lower it along a guide which is turnably supported, at least at its lower end, in the tank bottom and has its upper end at the rim or at an opening in the tank cover. These mixers are normally of the propeller type having a horizontal axis and functionally corresponding with side installed propeller mixers. This type of mixer has been used for a long time within the pulp industry for mixing large volumes.

A submersible mixer exerts a significant reaction force against the guide and also, depending on its alternation, a torque around the impeller axis which must be absorbed both by the guide and its attachments. The latter must be installed in an empty tank which sometimes means significant costs. It may also be unadvisable to attach a support bearing to the tank wall or to the bottom since then there is a risk that the wall surface may be damaged. In addition, such a support bearing may collect rags and other objects that may be present in the liquid.

SUMMARY OF THE INVENTION

According to the invention a method and a device for installing a submersible mixer are obtained which solve the above-mentioned problems and which in addition decrease the installation time from two days' work to two hours.

The present invention provides a method of positioning a guide member in the tank, the top end of which is pivotally mounted adjacent an opening in the top of the tank. The mixer is then lowered into the tank along the guide member and is positioned at the lower end of the member so that the guide member swings out when the reaction force of the mixer during operation is greater than the force of gravity.

An apparatus of the invention includes a guide element on which the mixer is positioned in the tank which element is mounted so as to swing out in opposition to the forces created when the mixer is in operation.

BRIEF DESCRIPTION OF THE DRAWING

Above-mentioned and other features and objects of this invention will become more apparent by reference to the following description taken in conjunction with the accompanying drawing, in which:

the sole FIGURE illustrates a vertical position and a reaction force position of a mixer and guide in a tank.

DETAILED DESCRIPTION OF THE PREFERRED EMBODIMENT

The invention includes a guide 18 which is supported pivotally in the opening of a tank 10 such that the guide 18 is allowed to swing out towards the tank wall, the wall taking the reaction force from the mixer via a shock absorber 30. The mixer 20 thus operates in its lower position on the guide 18 most of the time. Where the reaction force from the operation of the motor is strong enough, the guide 18 swings out with the rear section of the mixer at the leading edge of movement until the mixer 20 takes support from the tank wall. The position of the mixer will then correspond with that of a side installed mixer mentioned above and its vertical inclination may be chosen freely as long as the horizontal component of force is strong enough. As the guide 18 and the mixer 20 only take support against the wall during operation and, since the reaction force is partly counteracted by gravity, the pressure against the tank wall is considerably smaller when compared with that occurring at conventionally installed mixers on guides having a support on the wall and even smaller when compared with side installed mixers attached to a lead-in in the tank.

The proposed method is very suitable especially in sedimentation tanks for sludge from purification plants and liquid manure. These tanks have often a thick floating sludge cover, depending on lack of mixing, and are therefore very difficult to clean to permit installation of conventionally guided submersible mixers.

The most common type of tank such as the tank 10 which is shown in the drawing has an opening 12 at its upper central part and has a significant depth in relation to its diameter. By means of the proposed installation method, it is possible to arrange a ring shaped plate 14 between a cover 13 and the opening 12 on which a support 16 for the guide 18 is fixed whereafter the guide 18 is lowered into the tank 10 and hooked on the support 16. The mixer 20 may then be lowered along the guide 18 by help of a lifting tackle 22 mounted on the plate 14 or near the opening 12. An electric cable 24 to the mixer can be arranged in a waterfilled hose 25 and out through a sealing liquid filled tank 26 near the opening. In this way is ensured that the cable 24 will not be surrounded by explosive gas in the sediment tank 10 above the liquid surface. A level indicating means 28 in the sealing tank 10 ensures that the electric current is switched off if the liquid level is not high enough.

The installation of the submersible mixer 20 can be made very reliable. The hose 25 with the electric cable 24 and the lifting means 22 for the machine can be guided along the guide 18 and can be protected by the guide from rags which may become attached thereto. A ring-shaped element 32 retains the hose 25 on the guide 18. Thanks to the pivoting guide installation and by stopping the mixer and restarting it, for instance once a week, the advantage is obtained that possible collections of rags and the like between the guide 18 and the mixer 20 will fall down. The guide 18 will go down to its vertical position when the mixer stops. During this movement a fluid flow occurs over the mixer 20 and the guide 18 which flow is in a direction counter to the fluid flow occurring during operation.

Another advantage is that the mixer may be very easily taken out for inspection regardless of the fact that during operation it has a position which is very difficult to access from the tank opening. At demounting, the cover is removed, and the ring formed plate 14 with the guide 18 remain in their places when the mixer is hoisted.

In order to obtain a certain inclination of the working direction of the impeller with relation to the tank radius, the support 16 against the wall can be made of a high friction material or in another way be given the ability to take forces in the peripheral direction.

In order to ensure that the machine will not swing out in the opposite direction such that the front or propeller portion of the mixer is at the leading edge of movement, if the motor is connected incorrectly, the guide or the mixer itself may be provided with a position switch which disconnects the current when such movement is detected. Alternatively, the mixer or its connection box may be provided with a protection means against false phase sequence.

While we have described above the principles of our invention in connection with specific apparatus, it is to be clearly understood that this description is made only by way of example and not as a limitation to the scope of our invention as set forth in the objects thereof and in the accompanying claims.

What is claimed is:

1. A submersible mixer apparatus for a tank having significant depth in relation to its diameter and having an opening at its upper portion, comprising in combination:

an electrical submersible mixer having propeller type blades;

a shock absorber extending rearward of the blades of the mixer;

a support connected to the interior wall of the tank adjacent to the opening; and an elongated guide element having two opposed ends and along which the mixer is guided for positioning in the tank, one of said ends being mounted for pivotal movement on said support to permit movement of said element in response to the action created by the mixer during operation and the second of said ends being free to move toward the tank wall and supporting the mixer and absorber in a substantially perpendicular position with respect to the longitudinal axis of said element, such that the reaction force produced by the mixer blades during operation causes pivotal movement of the guide with said mixer and absorber moving toward a point on the interior surface of the tank to be supported against the tank wall during the operation, and the reaction force is partly counteracted by gravity which reduces the supporting pressure against the tank wall.

2. The apparatus according to claim 1 further comprising lifting means positioned on an upper portion of the tank for lifting and lowering the mixer respectively out of and into the tank.

3. The mixer according to claim 1 further comprising a flexible tubular member extending along said guide element from an upper portion of the tank to said mixer and an electrical cable extending in said tubular member.

4. The apparatus according to claim 3 further comprising a cover positioned on the opening and a receptacle positioned on said cover and filled with a sealing liquid, said tubular member passing through said cover and into said receptacle.

* * * * *